US008548352B2

(12) United States Patent
Tanaka et al.

(10) Patent No.: US 8,548,352 B2
(45) Date of Patent: Oct. 1, 2013

(54) DEVELOPER CONTAINER, DEVELOPING DEVICE, AND PROCESS CARTRIDGE

(75) Inventors: Takayuki Tanaka, Yokohama (JP); Shinichi Nishida, Kawasaki (JP); Norio Takahashi, Suntou-gun (JP); Takahiro Kawamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 627 days.

(21) Appl. No.: 12/704,858

(22) Filed: Feb. 12, 2010

(65) Prior Publication Data

US 2010/0226682 A1 Sep. 9, 2010

(30) Foreign Application Priority Data

Mar. 3, 2009 (JP) ..... 2009-049307
Nov. 11, 2009 (JP) ..... 2009-258099

(51) Int. Cl.
*G03G 15/08* (2006.01)

(52) U.S. Cl.
USPC ..... 399/106; 399/111; 399/120; 399/262

(58) Field of Classification Search
USPC ..... 399/91, 98, 102, 106, 110–114, 119, 399/120, 252, 258, 260, 262, 263; 222/DIG. 1
See application file for complete search history.

(56) References Cited

U.S. PATENT DOCUMENTS

| | | | | |
|---|---|---|---|---|
| 4,931,838 | A | 6/1990 | Ban et al. | |
| 6,188,855 | B1 * | 2/2001 | Fujioka | 399/106 |
| 6,585,848 | B2 * | 7/2003 | Chadani et al. | 156/285 |
| 6,684,040 | B2 * | 1/2004 | Yokoi et al. | 399/119 |
| 7,319,837 | B2 * | 1/2008 | Ahn | 399/258 |
| RE40,711 | E * | 5/2009 | Okiyama et al. | 399/262 |
| 7,561,836 | B2 * | 7/2009 | Takagi | 399/262 |

FOREIGN PATENT DOCUMENTS

| | | | |
|---|---|---|---|
| JP | 8-328369 | A | 12/1996 |
| JP | 2629945 | B2 | 4/1997 |
| JP | 3088053 | B2 | 7/2000 |
| JP | 2001-331028 | A | 11/2001 |
| JP | 2002-49239 | A | 2/2002 |

* cited by examiner

*Primary Examiner* — Hoan Tran
(74) *Attorney, Agent, or Firm* — Fitzpatrick, Cella, Harper & Scinto

(57) ABSTRACT

A developer container, which contains a developer to be supplied to a developing chamber in an electrophotographic image forming apparatus, the developer container including: a partition wall partitioning the container from the chamber; a conveying member conveying the developer to an opening in the partition wall to supply the developer to the chamber; a sealing member attached to a wall surface of the partition wall to cover the opening; an extending portion extending from the sealing member to an outside of the container, wherein, when the extending portion is pulled, the sealing member is separated into a remaining portion and a removal portion, and a free end of the remaining portion is positioned below an upper edge of the opening; and a spacing holding member disposed between the wall surface of the partition wall and the sealing member to hold a spacing between the wall surface and the sealing member.

21 Claims, 9 Drawing Sheets

DEVELOPER CONTAINER, DEVELOPING DEVICE, AND PROCESS CARTRIDGE

BACKGROUND OF THE INVENTION

1. Field of the Invention

The present invention relates to a developer container and a developing device of an electrophotographic image forming apparatus, and a process cartridge detachably mountable to an apparatus main body of the electrophotographic image forming apparatus.

2. Description of the Related Art

The electrophotographic image forming apparatus described herein is an apparatus that forms an image on a recording medium by using an electrophotographic image forming process. As the electrophotographic image forming apparatus, there are given, for example, an electrophotographic copying machine, an electrophotographic printer (for example, such as a color laser beam printer and a color LED printer), a facsimile machine, and a word processor.

Further, the process cartridge is detachably mounted onto an electrophotographic image forming apparatus main body (hereinafter, referred to as "apparatus main body"), and contributes to an image forming process for forming an image on a recording medium. In the process cartridge, at least one of a charging means, a developing means, and a cleaning means each serving as a process means and an electrophotographic photosensitive member are integrated into a cartridge, and the thus formed cartridge is detachably mounted to the apparatus main body. The charging means, the developing means, and the cleaning means which act on the electrophotographic photosensitive member (hereinafter, referred to as photosensitive member) are referred to as the process means. The process cartridge may integrally include the developing means and the photosensitive member, and is detachably mounted onto the apparatus main body. The process cartridge may integrally include the charging means, the developing means or the cleaning means, and the photosensitive member, and is detachably mounted onto the apparatus main body. The process cartridge, which integrally includes the photosensitive member and the developing means, is referred to as a so-called integral type. The process cartridge, which integrally includes the photosensitive member and the process means other than the developing means, is referred to as a so-called separation type. The developing cartridge includes a developing roller, and contains a developer (toner) used to develop an electrostatic latent image (hereinafter, referred to as a latent image) formed on the photosensitive member by the developing roller. In a case of the developing cartridge, the photosensitive member is provided to the apparatus main body, a cartridge supporting member, or in the so-called separation type process cartridge (in this case, the process cartridge has no developing means). Here, the developing cartridge and/or the process cartridge can be attached to and detached from the apparatus main body by the user him/herself. Therefore, the user him/herself can easily perform maintenance of the apparatus main body.

(Developing Device)

A dry developing system is used frequently in a developing device. As the dry developing system, there are a two-component developing system using a mixed agent of a toner and a carrier as a developer and a one-component developing system using substantially only a toner. The toner flowability and charging property of a toner are improved by allowing an extraneous additive to adhere to the surface of the toner. In the one-component developing system, a developing device mostly uses a two-chamber configuration of a developer container and a developing chamber. The developer container is filled with a developer (hereinafter, referred to as a toner), and has an agitating member conveying a toner to the developing chamber. The developing chamber has a developer supply member, a developer carrying member, and a developer layer thickness regulating member (hereinafter, referred to as a regulating member). The toner conveyed from the developer container to the developing chamber is allowed to adhere to the developer carrying member by the developer supply member, and is formed into a thin layer and charged by the regulating member. The developer carrying member is supplied with a voltage, and when the toner on the developer carrying member is opposed to an image bearing member, the toner moves to an electrostatic latent image on the image bearing member with an electrostatic force, whereby an electrostatic latent image is developed with toner. Most of the toner that has not been used for development is peeled from the developer carrying member by the developer supply member to be collected into the developing device. The toner in the developing device is thus subjected to friction by the regulating member and the developer supply member. The extraneous additive adhering to the surface of the toner is buried inside the toner or peeled from the toner due to the friction, which degrades the toner. Further, the toner peeled from the developer carrying member mostly has a large particle size. Therefore, as the use of the toner in the developing device proceeds, the particle size distribution changes, and the ratio of the toner with a large particle size increases. The toner flowability and the charging property of the toner in the developing device are degraded gradually.

(Opening of Developer Container and Developing Chamber)

In the case where the developer container and the developing chamber are partitioned with a partition wall having an opening on a plane, a toner moves from the developer container to the developing chamber during use, and the toner also moves from the developing chamber to the developer container. Therefore, the toner that is degraded in the developing chamber and changed in a particle size distribution returns to the developer container. In this case, the toner in the developer container and the developing chamber is degraded as a whole, and hence, toner characteristics are greatly decreased in the later period of the use though the change in toner characteristics is small in the initial period of the use. In order to suppress the decrease in the toner characteristics in the later period of the use, a method of regulating the movement of the toner from the developing chamber to the developer container by the shape of the opening is used. Thus, the toner which is changed in characteristics, and presents in the developing chamber, is used first, and then, the toner in the developer container can keep the initial characteristics even in the later period of the use. As the shape of the opening for regulating the movement of a toner, there is a system for adding an open/close member to the opening (see, for example, Japanese Patent Application Laid-Open No. 2001-331028). Further, there is a partition wall provided with a first partition member extending upward from the bottom of the developing device, and a second partition member disposed on the developing chamber side from the first partition member and extending downward from the upper portion of the developing device. An upper edge portion of the first partition member and a lower edge portion of the second partition member form an opening communicating the developer container with the developing chamber. Then, a system is proposed, which regulates the movement of a toner by appropriately setting the position of the upper edge portion of the first partition member (see Japanese Patent Application Laid-Open No. 2002-049239).

(Toner Seal)

The toner in the developing chamber during use is confined in the developing device by bringing the regulating member and the sealing member around the developer carrying member into contact with the developer carrying member. However, if a toner is placed in the developing chamber before the start of the use, when a shock is applied to the developing chamber during transportation, the regulating member and the sealing member may be vibrated to leave from the developer carrying member. Therefore, there is a possibility that toner leakage may occur. Therefore, the opening provided in the partition wall between the developer container and the developing chamber is covered with a sealing film (a toner seal), thereby sealing the toner in the developer container until the start of the use. In use, a user removes a part of the sealing film to undo the sealing so that the toner can be supplied from the developer container to the developing chamber through the opening. As a system for sealing the opening, the following system is exemplified. A sealing film made of an adhesive layer containing a biaxially-oriented polypropylene layer and an ethylene-vinyl acetate copolymer as main components is attached to the partition wall so as to cover the opening. Then, one end portion of the sealing film is folded to extend to the outside of the developing device (see Japanese Patent No. 3,088,053). In use, a user pulls out the sealing film extending to the outside of the developing device, whereby the adhesive layer of the sealing film is peeled and the sealing film is removed. Thus, the opening is unsealed, and the toner can move from the developer container to the developing chamber. As another system, there is a sealing film mainly made of a biaxially-oriented polypropylene layer with a cut line (ripping line, i.e., tear-off line) formed by a laser along the periphery at which an opening is formed. The sealing film is attached to a wall surface having an opening. Then, one end portion of the sealing film is folded to extend to the outside of the developing device (see Japanese Patent Application Laid-Open No. H08-328369). In use, a user pulls out the sealing film extending to the outside of the developing device, whereby the sealing film is torn apart along the cut line and a part of the sealing film is removed. Thus, the opening is unsealed, and the toner can move from the developer container to the developing chamber. As still another system, the sealing film mainly made of a monoaxially-oriented foamed polypropylene layer is attached to a wall surface having an opening. A flexible film is attached along the surface opposed to the opening of the sealing film. One end portion of the flexible film is folded to extend to the outside of the developing device (see Japanese Patent No. 2,629,945). In use, a user pulls out a flexible film extending to the outside of the developing device, whereby the sealing film is torn apart with substantially the same width as that of the flexible film, and a part of the sealing film is removed. Thus, the developer container is connected to the developing chamber.

In the case of carrying out the method of sealing an opening during transportation on an opening having a configuration in which a change in characteristics of the toner is suppressed by controlling the movement of a developer from the developer container to the developing chamber, there are the following problems.

In the case of using an open/close member for an opening as disclosed in Japanese Patent Application Laid-Open No. 2001-331028, the open/close member has a role of controlling the movement of a developer and a role of sealing the developer container. In order to prevent the leakage of the toner due to the shock during transportation, it is necessary to enhance the stiffness of the open/close member. However, with an open/close member having high stiffness, a toner cannot be supplied from the developer container to the developing chamber at a required speed during use. Therefore, in the case where images with a high coverage rate are printed continuously, there are problems that the density of an image may be degraded or a part of an image may fade to white.

In the case where upper and lower partition walls of the opening are out of alignment as disclosed in Japanese Patent Application Laid-Open No. 2002-049239, it is necessary to seal the developer container by attaching a toner seal to the opening so as to prevent the leakage of a toner during transportation. In this configuration, it is necessary to attach the toner seal to the partition walls being out of alignment, and hence, it is difficult to attach the toner seal.

The conventional toner seal cannot simultaneously satisfy the function of regulating the movement of the toner from the developing chamber to the developer container while supplying the toner from the developer container to the developing chamber at a sufficient speed, and the ease of attachment to the developer container.

SUMMARY OF THE INVENTION

An object of the present invention is to provide a developer container for containing a developer to be supplied to a developing chamber used in an electrophotographic image forming apparatus, including: a partition wall configured to partition the developer container from the developing chamber; a conveying member configured to convey the developer to an opening provided in the partition wall so as to supply the developer in the developer container to the developing chamber; a sealing member that is attached to a wall surface of the partition wall on a side of the developing chamber and covers the opening; an extending portion that is provided on the sealing member and extends from the sealing member to an outside of the developer container, wherein when the extending portion is pulled, the sealing member is separated into a remaining portion and a removal portion, and a free end of the remaining portion is positioned below an upper edge of the opening; and a spacing holding member disposed between the wall surface of the partition wall and the sealing member, and configured to hold a spacing between the wall surface and the sealing member.

Further, another object of the present invention is to provide a developing device having the above-mentioned developer container. Still further, another object of the present invention is to provide a process cartridge having the above-mentioned developing device.

Another object of the present invention is to reduce the movement of a developer from the developing chamber to the developer container.

Further, another object of the present invention is to supply the developer from the developer container to the developing chamber at a sufficient speed.

Further, another object of the present invention is to seal a developer container so as to prevent the leakage of the developer during transportation.

Further, another object of the present invention is to easily attach a toner seal so as to close the opening between the developer container and the developing chamber.

Further features of the present invention will become apparent from the following description of exemplary embodiments with reference to the attached drawings.

DESCRIPTION OF THE EMBODIMENTS

Hereinafter, a best mode for carrying out the invention is described in detail illustratively. It should be noted that the size, material, shape of constituent members described in the embodiments, the relative arrangement thereof, and the like should be changed appropriately depending upon the configuration and various conditions of an apparatus to which the present invention is applied, and are not intended to limit the range of the invention to the following embodiments.

In this specification, regarding the configuration and operation of a developer container, a developing device, or a process cartridge, the terms representing the directions such as upper, lower, vertical, and horizontal indicate the direction when they are viewed in a normal use state, unless otherwise specified. That is, the normal use state of the developer container, the developing device, or the process cartridge is a state in which they are mounted suitably on an image forming apparatus main body disposed suitably and can be subjected to an image forming operation.

(Electrophotographic Image Forming Apparatus)

Figure 5:
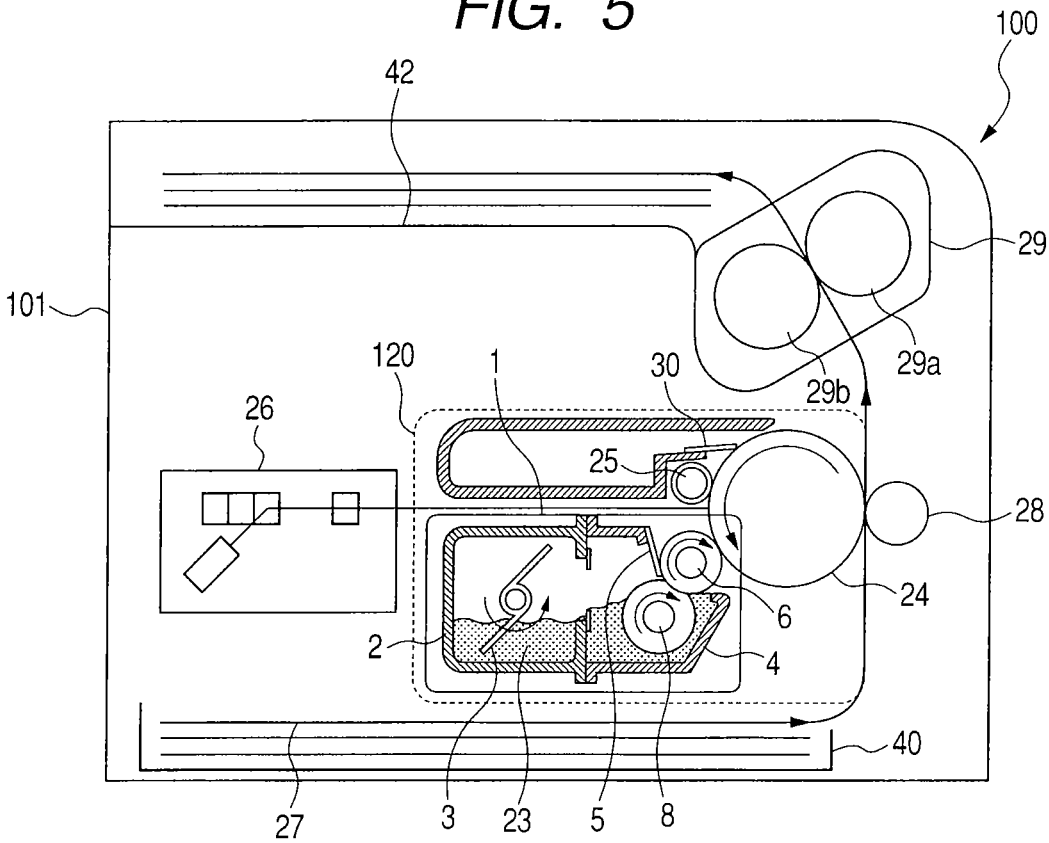
FIG. 5 is a schematic view of an electrophotographic image forming apparatus.

An electrophotographic image forming apparatus (hereinafter, referred to as an image forming apparatus) 100 using an electrophotographic printing method is described with reference to FIG. 5. An image forming apparatus 100 of this method includes an image bearing member (for example, an electrophotographic photosensitive member) 24, a charging device 25, an exposure device 26, a developing device 1, a transfer device 28, a fixing device 29, and a cleaning device 30. The image bearing member 24 has photoconductivity. The charging device 25 charges the image bearing member 24. The exposure device 26 exposes the image bearing member 24 to light. The developing device 1 has a developer container 2 containing a developer 23 and a developer carrying member (for example, a developing roller) 6. The transfer device 28 generates a transfer electric field between the image bearing member 24 and a recording material 27. The fixing device 29 has a heating member 29*a* and a pressure member 29*b*. The cleaning device 30 removes the developer 23 on the image bearing member 24. Image formation is performed in the following process. The image bearing member 24 rotates in a counterclockwise direction indicated by an arrow. First, the charging device 25 charges the surface of the image bearing member 24 uniformly. Then, the exposure device 26 selectively exposes the uniformly charged surface of the image bearing member 24 with light in accordance with an image signal, thereby forming an electrostatic latent image on the surface of the image bearing member 24. The developer 23 in the developer container 2 of the developing device 1 is conveyed to a developing chamber 4 by an agitating member 3 rotating in a counterclockwise direction. The developer in the developing chamber 4 is supplied to the developer carrying member 6 by a developer supply member 8. The developer carrying member 6 is rotatably supported by the developing chamber 4. The developer carried on the developer carrying member 6 has a layer thickness regulated by a developer layer thickness regulating member 5 and is charged by the developer layer thickness regulating member 5. When the developer 23 is moved from the developer carrying member 6 to the image bearing member 24 by an electrostatic force, the electrostatic latent image on the image bearing member 24 is developed with the developer 23 to form a developer image. The recording material 27 contained in a recording material container 40 is conveyed to a transfer nip between the image bearing member 24 and the transfer device 28 at a predetermined timing. When an electric field is applied by the transfer device 28 while the developer image on the image bearing member 24 is opposed to the recording material 27, the developer image is transferred to the recording material 27. The developer image on the recording material 27 is heated and pressed by the fixing device 29 to be fixed on the recording material 27. The recording material 27 with an image formed thereon is discharged onto a discharge tray 42. The developer remaining on the image bearing member 24 without being transferred is removed by the cleaning device 30.

(Cartridge)

The use limit of the constituent members of the image forming apparatus may become shorter than the use limit of the image forming apparatus due to the consumption, abrasion, etc. In order for a user to exchange those members easily, the components required to be exchanged are integrated into a detachably mountable cartridge. Examples of the configuration of a cartridge include the configuration formed of only the developer container 2, the configuration formed of the developing device 1, and the configuration formed of the developing device 1, the image bearing member 24, the charging device 25, and the cleaning device 30. More specifically, the image bearing member 24, at least one of the charging device 25 and the cleaning member 30, and the developing device 1 having the developer container 2 and the developer carrying member 6 may be integrated into a cartridge as a process cartridge 120. The process cartridge 120 is removably mounted to the apparatus main body 101. The charging device 25 or the cleaning member 30 is a process means that acts on the image bearing member 24. Further, the process cartridge 120 in which the developing device 1 having the developer container 2 and the developer carrying member 6 and the image bearing member 24 are integrated into a cartridge may be removably mounted to the apparatus main body 101. Still further, the developing device 1 having the developer container 2 and the developer carrying member 6 may be removably mounted to the apparatus main body 101 as the developing cartridge 1. Still further, the developer container 2 may be removably mounted to the apparatus main body 101 as the developer cartridge 2.

(Apparatus Main Body)

The apparatus main body 101 of the image forming apparatus 100 is a portion of the image forming apparatus excluding the above-mentioned cartridge.

(Configuration of Developing Device)

The developing device is described with reference to FIGS. 1A to 1D. The developing device 1 has the developer container 2 and the developing chamber 4. The developer container 2 contains a developer (hereinafter, referred to as toner), in which the agitating member 3 is disposed rotatably. The agitating member 3 also plays a role as a conveying member that conveys the toner. The toner is a non-magnetic toner produced by a suspension polymerization method, which has an average particle size of about 6.5 micrometers (μm). In order to improve the surface property, silicon oxide particles of about 20 nanometers (nm) are allowed to uniformly adhere to the surface of the toner in an amount of about 1.5% of the toner weight. The developing chamber 4 is disposed in contact with the developer container 2. In the developing chamber 4, the developer supply member 8 and the developer carrying member 6 in contact therewith are disposed so as to rotate. The developer supply member 8 is a roller with a diameter of 14 millimeters (mm) made of urethane foam. The developer carrying member 6 is a conductive elastic member (viscoelastic member) with a length of 230 mm and a diameter of 16 mm. During use, the developer carrying member 6 is rotated at a surface speed of 200 millimeters per second (mm/sec) counterclockwise in FIG. 1C. The regulating member 5 and the developer carrying member 6 are in contact with each other at a contact width of about 1.4 mm. A free end 5*a* of the regulating member 5 is in contact with the developer carrying member 6 at an edge portion of a contact portion 5*b* between the regulating member 5 and the developer carrying member 6. The contact force per unit length of the regulating member 5 and the developer carrying member 6 is 20 Newtons per meter (N/m). Thus, after the toner on the developer carrying member 6 comes into contact with the regulating member 5, the toner adhesion amount per unit area on the developer carrying member 6 is about 0.4 milligram per square centimeter (mg/cm$^2$), and the toner charge amount is about −30 microcoulomb per gram (uC/g). The developing chamber 4 is sealed with the developer carrying member 6 and the sealing member 7 and the regulating member 5 in contact with the developer carrying member 6 so that a developer does not leak.

Embodiment 1

Figure 1A:
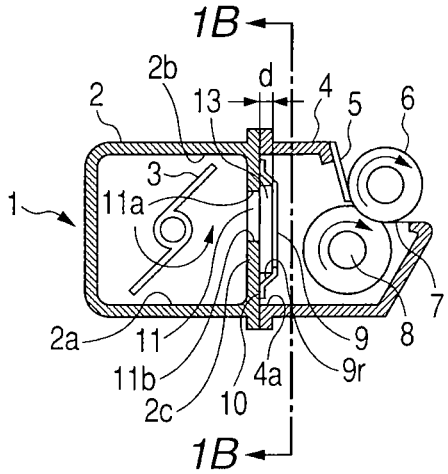
FIGS. 1A and 1B are schematic views of Embodiment 1 before opening a toner seal.
Figure 1B:
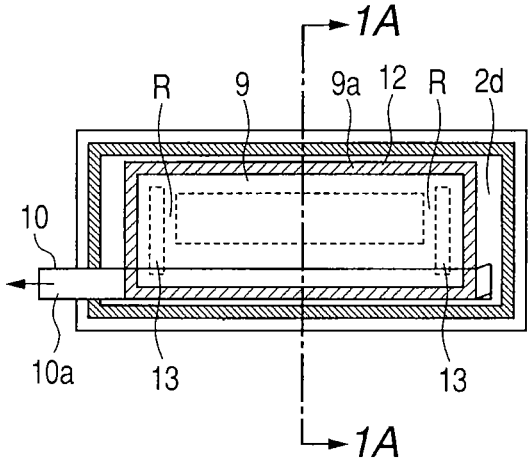
Figure 1C:
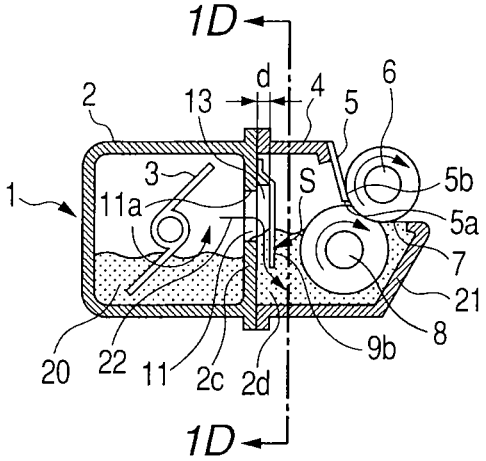
FIGS. 1C and 1D are schematic views of Embodiment 1 after opening the toner seal.
Figure 1D:
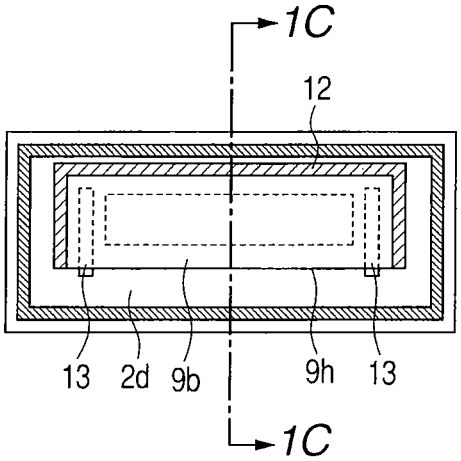

FIGS. 1A and 1B are schematic views of the developing device of Embodiment 1 before a toner seal is opened. FIGS. 1C and 1D are schematic views of the developing device of Embodiment 1 after the toner seal is opened. FIG. 1A is a cross-sectional view taken along the line 1A-1A of FIG. 1B. FIG. 1B is a cross-sectional view taken along the line 1B-1B of FIG. 1A. FIG. 1C is a cross-sectional view taken along the line 1C-1C of FIG. 1D. FIG. 1D is a cross-sectional view taken along the line 1D-1D of FIG. 1C.

The developer container 2 and the developing chamber 4 are partitioned by a partition wall 2*c* with a height of 24 mm from a bottom surface 2*a* to a top surface 2*b* of the developer container 2. The partition wall 2*c* is provided with an opening 11 with a width of 8 mm in a vertical direction. A lower edge 11*b* of the opening 11 has a height of 10 mm from a bottom surface 4*a* of the developing chamber 4. In the partition wall 2*c*, a protrusion 13 with a height of 2 mm is formed integrally with a wall surface 2*d* as a spacing holding member (spacing holding means) on the wall surface 2*d* on the developing chamber side on both sides of the opening 11. An entire peripheral portion 9*a* of a sealing film 9 is attached to the wall surface 2*d* on the developing chamber side of the partition wall 2*c* while the sealing film 9 is stretched in an omnidirection of the surface parallel to the wall surface 2*d*. The protrusion 13 holds a spacing "d" between the wall surface 2*d* and the sealing film 9. As illustrated in FIG. 1B, an attached position 12 of the sealing film 9 corresponds to the entire peripheral portion 9*a* of the sealing film 9. The attached position 12 provided on the wall surface 2*d* has a plane shape without steps. Such attachment enables the sealing film 9 to be stretched without looseness, and hence, the wall surface 2*d* and the sealing film 9 have substantially the same spacing "d" as the height of the protrusion 13 in a region R on an inner side of (closer toward the center than) the protrusion 13. The spacing "d" is a distance from the wall surface 2*d* on the side of the developing chamber 4 of the partition wall 2*c* provided with the opening 11 to the surface of the sealing film 9 on the side of the developer container 2 in a direction in which the toner 20 in the developer container 2 is directed to the developing chamber 4 through the opening 11. The sealing film 9 is formed of three layers: a monoaxially-oriented foamed polypropylene layer with a thickness of 12 μm, an aluminum layer with a thickness of 7 μm, and an adhesive layer (polyethylene) with a thickness of 30 μm. A flexible tape (hereinafter, referred to as a tear tape) 10 that is a flexible film extends along one surface side of the sealing film 9 opposed to the opening 11 with a width of 5 mm from the position of 4 mm below the lower edge 11*b* of the opening 11. The tear tape 10 is formed of three layers: a first adhesive layer (polyethylene) with a thickness of 30 μm, a polyester layer with a thickness of 25 μm, and a second adhesive layer (polyethylene) with a thickness of 30 μm. The first adhesive layer of the tear tape 10 is attached to the sealing film 9, and the second adhesive layer is attached to the wall surface 2*d* of the partition wall 2*c*. One end portion of the tear tape 10 is folded to extend to the outside of the developing device 1, thereby forming an extending portion 10*a*. The toner 20 is sealed in the developer container 2 by a sheet member (hereinafter, referred to as a toner seal in this embodiment) as a sealing member formed of the sealing film 9 and the tear tape 10. In this embodiment, the protrusion 13 as the spacing holding member (spacing holding means) is formed integrally with the wall surface 2*d* of the developing chamber 4. However, the present invention is not limited thereto, and the protrusion 13 may be formed integrally with the sheet member (toner seal).

(Description of Role of Toner Seal)

The toner seal prevents the toner from leaking outside the developing device 1 during transportation. In use, a user pulls out the tear tape 10 from the developing device 1 while holding one end portion (extending portion 10*a*) of the tear tape 10 extending to the outside of the developing device 1. As the tear tape 10 is pulled out, the sealing film 9 is torn off in substantially the same width as that of the tear tape 10 and taken out of the developing device 1. More specifically, the sealing film 9 is separated into a remaining portion 9*b* and a removal portion 9*r* when one end portion (extending portion 10*a*) of the tear tape 10 is pulled out. The remaining portion 9*b* remains so as to cover the opening 11, and the removal portion 9*r* is removed from the opening 11. The removal portion 9*r* is taken out of the developer container 2. In the developing device 1 with the tear tape 10 removed, a part 9*b* of the sealing film 9 remains, as illustrated in FIGS. 1C and 1D. A free end 9*h* of the sealing film 9 is positioned below the upper edge 11*a* of the opening 11. In particular, in Embodiment 1, the free end 9*h* of the sealing film 9 is positioned below the lower edge 11*b* of the opening 11.

(Opening of Developer Container and Developing Chamber)

In the developing device 1 with the toner seal opened, a space (a buffer portion) S sandwiched between the partition wall and the sealing film is formed. The buffer portion S controls the movement of the toner between the developer container 2 and the developing chamber 4. Referring to FIG. 1C, when the developing device 1 is driven, the agitating member (conveying member) 3 disposed in the developer container 2 rotates, and the toner 20 moves toward the opening 11. The toner 20 directed from the developer container 2 to the developing chamber 4 is not supplied directly to the developer supply member 8 because the remaining portion 9*b* of the sealing film 9 is present on the developing chamber side of the opening 11. The toner 20 has its flow changed to a downward direction (direction indicated by an arrow in FIG. 1C) along the remaining portion 9*b* of the sealing film 9. The wall surface 2*d* of the partition wall 2*c* and the remaining portion 9*b* of the sealing film 9 form a passage configured to convey downward the toner 20, which is conveyed from the developer container 2 to the developing chamber 4. The remaining portion 9*b* of the sealing film 9 is disposed at the spacing "d" with respect to the wall surface 2*d* of the partition wall 2*c*. Therefore, the space (the buffer portion) S sandwiched between the wall surface 2*d* below the opening 11 and the remaining portion 9*b* of the sealing film 9 is formed. The toner 20 is supplied to the developing chamber 4 via the buffer portion S. Because there is no toner in the developing chamber 4 before the developing device 1 starts being used, the toner 20 having reached the opening 11 passes through the buffer portion S to move to the developing chamber 4. While the developing chamber 4 is filled with the toner 21, the toner in the buffer portion S cannot move to the developing chamber 4 and is accumulated in the buffer portion S to become an immobile layer. Even if the agitating member (conveying member) 3 of the developer container 2 rotates, the opening 11 is closed with the toner that has become an immobile layer, and hence, the toner 20 cannot pass through the buffer portion S and is returned into the developer container 2. When the developing device 1 develops a latent image on the image bearing member 24 with the toner and the toner 21 in the developing chamber 4 is consumed, the toner in the buffer portion S moves to the developing chamber 4 by the consumed amount. Then, the toner 20 moves from the developer container 2 to a vacated space in the buffer portion S. Thus, due to the immobile layer formed in the buffer portion S, the toner 21 can be prevented from moving from the developing chamber 4 to the developer container 2. Consequently, the toner 20 in the developer container 2 maintains an unused state. In the developing device 1, the degraded toner 21 in the developing chamber 4 is first consumed, and then, the toner 20 in an unused state is supplied from the developer container 2 to the developing chamber 4 by the consumed amount. This enables a stable image quality to be maintained over a long period of time. Further, the toner 20 is supplied sequentially from the buffer portion S to the developing chamber 4 by the amount of the toner consumed from the developing chamber 4 by development, and hence, even in the case where images with a high coverage rate are printed continuously, the variation in an image density can be suppressed.

Comparative Example 1

Figure 2A:
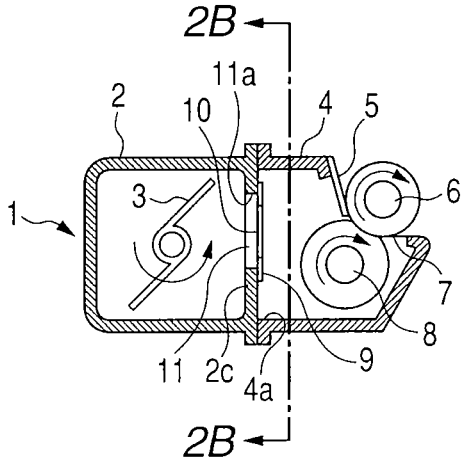
FIGS. 2A and 2B are schematic views of Comparative Example 1 before opening the toner seal.
Figure 2B:
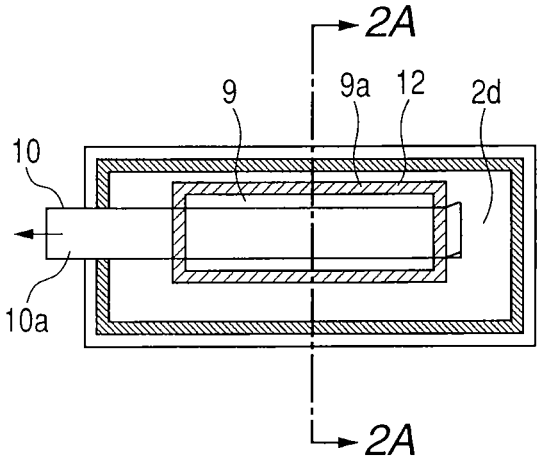
Figure 2C:
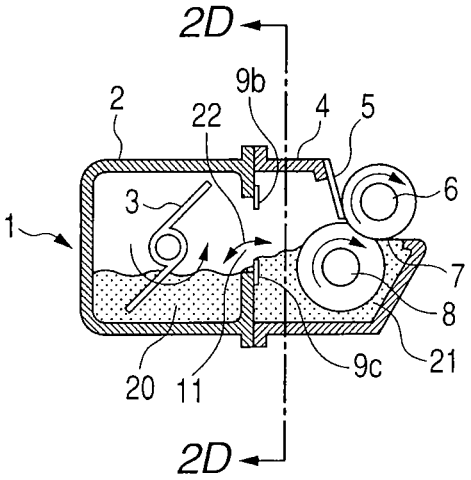
FIGS. 2C and 2D are schematic views of Comparative Example 1 after opening the toner seal.
Figure 2D:
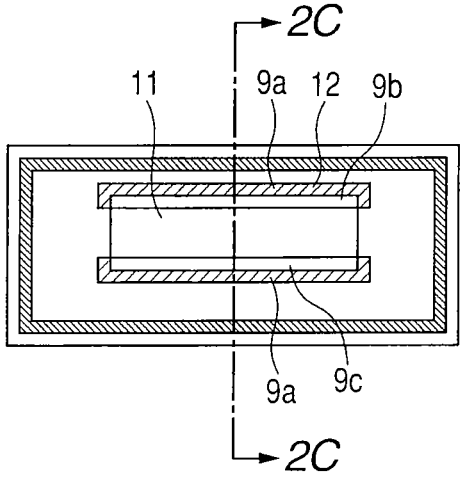

FIGS. 2A to 2D are schematic views of a developing device of Comparative Example 1. FIGS. 2A and 2B are schematic views of the developing device of Comparative Example 1 before a toner seal is opened. FIGS. 2C and 2D are schematic views of the developing device of Comparative Example 1 after the toner seal is opened. FIG. 2A is a cross-sectional view taken along the line 2A-2A of FIG. 2B. FIG. 2B is a cross-sectional view taken along the line 2B-2B of FIG. 2A. FIG. 2C is a cross-sectional view taken along the line 2C-2C of FIG. 2D. FIG. 2D is a cross-sectional view taken along the line 2D-2D of FIG. 2C. The same constituent elements as those in Embodiment 1 are denoted with the same reference numerals as those therein, and the description thereof is omitted. The developer container 2 and the developing chamber 4 are partitioned by the partition wall 2*c* with a height of 24 mm. The partition wall 2*c* has the opening 11 with a width of 8 mm from a position of 10 mm from the bottom surface 4*a* of the developing chamber 4. The entire peripheral portion 9*a* of the sealing film 9 is thermo-welded to the wall surface 2*d* on a developing chamber side of the partition wall 2*c*. As illustrated in FIG. 2B, the attached position 12 of the sealing film 9 corresponds to the entire peripheral portion 9*a* of the sealing film 9. The opening 11 is sealed with the sealing film 9 thermo-welded to the partition wall 2*c*. The sealing film 9 has the same configuration as that of Embodiment 1. The tear tape 10 that is a flexible film extends along the surface of the sealing film 9 opposed to the opening 11, with the width of 6 mm from a position of 2 mm below the upper edge 22*a* of the opening 11. One end portion of the tear tape 10 is folded to extend to the outside of the developing device 1. The toner 20 is sealed in the developer container 2 with a toner seal formed of the sealing film 9 and the tear tape 10.

In use, a user pulls out the tear tape 10 from the developing device 1 while holding one end portion of the tear tape 10 extending to the outside of the developing device 1. As the tear tape 10 is pulled out, the sealing film 9 is torn off in substantially the same width as that of the tear tape 10 and taken out of the developing device 1. As illustrated in FIGS. 2C and 2D, after the tear tape 10 is removed, the upper-side remaining portion 9*b* and the lower-side remaining portion 9*c* of the sealing film 9 remain in the developing device 1. Even after the toner seal is opened, the upper and lower portions of the opening 11 are covered with the remaining portions 9*b* and 9*c* of the sealing film 9. Therefore, the substantial width of the opening 11 becomes the width of the removed sealing film.

In the case of Comparative Example 1, a buffer portion is not formed between the developer container 2 and the developing chamber 4. Thus, when the developing device 1 is used, as indicated by an arrow 22 in FIG. 2C, the toner 21 moves from the developing chamber 4 to the developer container 2 simultaneously with the movement of the toner 20 from the developer container 2 to the developing chamber 4.

Comparative Example 2

Figure 3A:
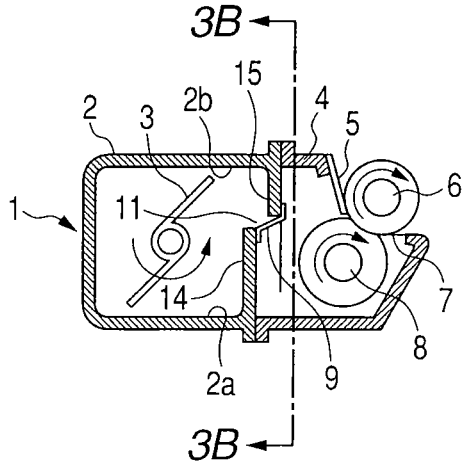
FIGS. 3A and 3B are schematic views of Comparative Example 2 before opening the toner seal.
Figure 3B:
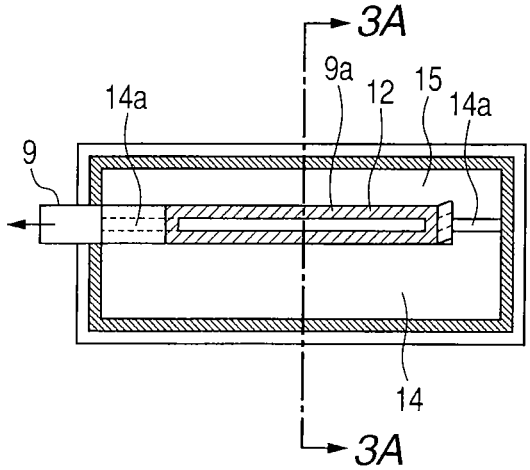
Figure 3C:
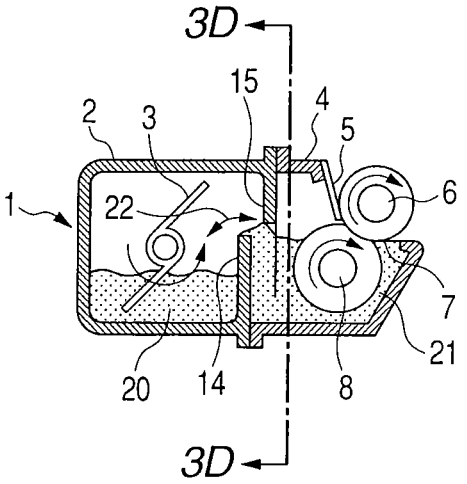
FIGS. 3C and 3D are schematic views of Comparative Example 2 after opening the toner seal.
Figure 3D:
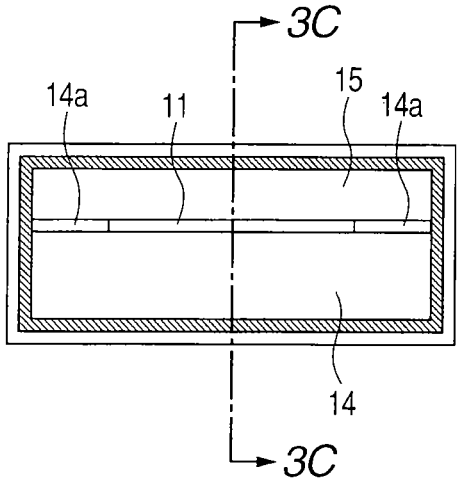

FIGS. 3A to 3D are schematic views of a developing device of Comparative Example 2. FIGS. 3A and 3B are schematic views of the developing device of Comparative Example 2 before a toner seal is opened. FIGS. 3C and 3D are schematic views of the developing device of Comparative Example 2 after the toner seal is opened. FIG. 3A is a cross-sectional view taken along the line 3A-3A of FIG. 3B. FIG. 3B is a cross-sectional view taken along the line 3B-3B of FIG. 3A. FIG. 3C is a cross-sectional view taken along the line 3C-3C of FIG. 3D. FIG. 3D is a cross-sectional view taken along the line 3D-3D of FIG. 3C. The same constituent elements as those in Embodiment 1 are denoted with the same reference numerals as those therein, and the description thereof is omitted. The developer container 2 and the developing chamber 4 are partitioned by the first partitioning member 14 and the second partitioning member 15. A first partitioning member 14 is a partition wall extending 14 mm upward from the bottom surface 2*a* of the developer container 2. A second partitioning member 15 is displaced from (out of alignment with) the first partitioning member 14 to the developing chamber 4 by 4 mm. The second partitioning member 15 is a partition wall extending 8 mm downward from the top surface 2*b* of the developer container 2. The first partitioning member 14 and the second partitioning member 15 are connected smoothly by a connecting portion 14*a* on both sides of the opening 11. The sealing film 9 is thermo-welded to the first partitioning member 14, the second partitioning member 15, and the connecting portion 14*a* so as to cover the opening 11 across the first partitioning member 14 and the second partitioning member 15. As illustrated in FIG. 3B, the attached position 12 of the sealing film 9 corresponds to a thermo-welded portion 9*a* of the sealing film 9. The sealing film 9 is formed of four layers: a biaxially-oriented polypropylene layer with a thickness of 30 μm, a nylon layer with a thickness of 15 μm, a polyethylene layer with a thickness of 20 μm, and an adhesive layer (containing an ethylene-vinyl acetate copolymer as a main component) with a thickness of 30 μm. One end portion of the sealing film 9 is folded to extend to the outside of the developing device 1. The toner 20 is sealed in the developer container 2 with a toner seal formed of the sealing film 9.

In use, a user pulls out the sealing film 9 from the developing device 1 while holding one end portion of the sealing film 9 extending to the outside of the developing device 1. The sealing film 9 is taken out of the developing device 1 with an adhesive layer peeled off. FIGS. 3C and 3D illustrate the developing device 1 after the sealing film 9 is removed. The sealing film 9 is removed as a whole, and hence the developer container 2 and the developing chamber 4 are partitioned by the first partitioning plate 14 and the second partitioning plate 15, as disclosed in Japanese Patent Application Laid-open No. 2002-049239.

When the developing device 1 is driven, the first partitioning plate 14 reduces the amount of the toner 21 returning from the developing chamber 4 to the developer container 2. Further, the second partitioning plate 15 prevents the toner 20 from moving from the developer container 2 directly to the developer supply member 8. The first partitioning plate 14 and the second partitioning plate 15 limit the movement of the toner between the developer container 2 and the developing chamber 4.

Comparative Example 3

Figure 4A:
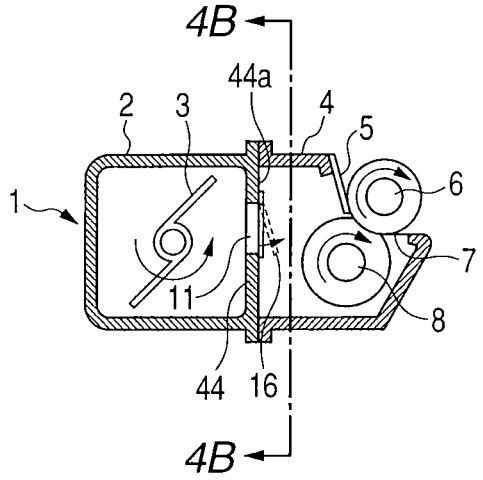
FIGS. 4A and 4B are schematic views of Comparative Example 3.
Figure 4B:
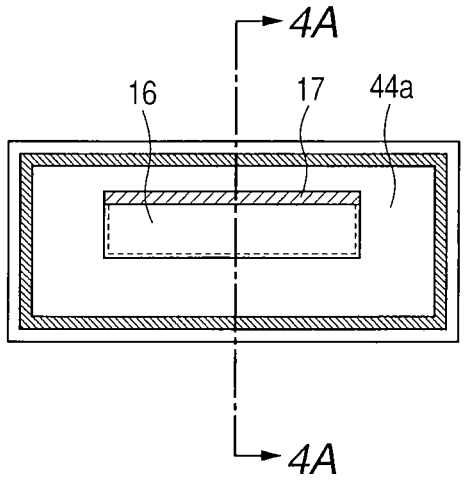

FIGS. 4A and 4B are schematic views of a developing device of Comparative Example 3. FIG. 4A is a cross-sectional view taken along the line 4A-4A of FIG. 4B. FIG. 4B is a cross-sectional view taken along the line 4B-4B of FIG. 4A. The developer container 2 and the developing chamber 4 are partitioned by a partition wall 44 provided with the opening 11 having a width of 8 mm in a vertical direction. An open/close member 16 of polyethylene terephthalate with a thickness of 100 μm attached to a wall surface 44*a* of the partition wall 44 on the side of the developing chamber 4 above the opening 11 at an attached position 17 covers the opening 11. The other configuration is the same as that in Embodiment 1. The same constituent elements as those in Embodiment 1 are denoted with the same reference numerals as those therein, and the description thereof is omitted. When the developing device 1 is driven, a toner pushed by the agitating member (conveying member) 3 rotating in the developer container 2 pushes and opens the open/close member 16 in a sheet shape covering the opening 11, and moves the toner from the developer container 2 to the developing chamber 4. In the case where there is a sufficient toner in the developing chamber 4, the toner in the developing chamber 4 prevents the toner from opening the open/close member 16. This limits the movement of the toner between the developer container 2 and the developing chamber 4.

(Comparison Between Embodiment 1 and Comparative Examples 1 to 3)

Embodiment 1 and Comparative Examples 1 to 3 were evaluated for the ease of attachment of a toner seal, the leakage of toner during transportation, the density follow-up property, and the toner exchange property of the developer container and the developing chamber. Herein, the methods of evaluating the leakage of toner during transportation, the density follow-up property, and the toner exchange property between the developer container and the developing chamber are as follows.

(Method of Evaluating Leakage of Toner During Transportation)

A developing device was placed in a predetermined package and subjected to a dropping test. The developing device was dropped 10 times from a height of 90 cm to a concrete surface in the order of one corner, three edges, and six surfaces. Then, the dropped developing device was unpackaged and evaluated for the leakage of toner outside of the developing device. This test was conducted with respect to 20 developing devices, and evaluated based on the following criteria.

Good: No leakage of toner occurs.

Unsatisfactory: Leakage of toner occurs once.

Bad: Leakage of toner occurs at least twice.

(Method of Evaluating Density Follow-Up Property)

A developing device was filled with a toner in an amount required for printing 400 sheets of A4 size with the maximum density over the entire surface, and the 400 sheets of A4 size were printed continuously with the maximum density over the entire surface in an environment of a temperature of 23° C. and a humidity of 50%. Whether or not there was a portion in which the density was degraded in the 400 printed images was evaluated by visual inspection. The evaluation was conducted based on the following criteria.

Good: There is no portion where the density is degraded.

Unsatisfactory: The degradation in density is observed in a region of less than 5% of an image area.

Bad: The degradation in density is observed in a region of 5% or more of an image area.

(Toner Exchange Property Between Developing Container and Developing Chamber)

In development, toner with a small particle size is used selectively, and hence, the volume average particle size of a toner in the developing chamber increases. In the case where toner is exchanged frequently, the particle size difference between the developer container and the developing chamber is small. However, in the case where toner is not exchanged, the particle size difference between the developer container and the developing chamber becomes large. Then, a developing device is filled with a toner in an amount required for printing 400 sheets of A4 size with the maximum density over the entire surface of each sheet, and 15000 sheets of A4 size were printed continuously with the maximum density at an area ratio of 5% in an environment of a temperature of 23° C. and a humidity of 50%. The toner after printing was sampled respectively from the developer container and the developing chamber and the volume average particle size thereof was measured, and the toner exchange property between the developer container and the developing chamber was evaluated from the particle size difference. The evaluation was conducted based on the following criteria.

Good: Particle size difference ≥1.0 μm

Unsatisfactory: 0.5 μm≤particle size difference <1.0 μm

Bad: Particle size difference <0.5 μm (Evaluation Results)

Table 1 shows the evaluation results.

TABLE 1

| | Embodiment 1 | Comparative Example 1 | Comparative Example 2 | Comparative Example 3 |
|---|---|---|---|---|
| Ease of attachment of toner seal | Good | Good | Bad | Good |
| Leakage of toner during transportation | Good | Good | Unsatisfactory | Bad |
| Density follow-up property | Good | Good | Good | Unsatisfactory |
| Toner exchange property between toner storage container and developing chamber | Good | Bad | Unsatisfactory | Good |

Regarding the ease of attachment of the toner seal, it is relatively easy to attach a toner seal to a flat surface. However, in the case where the upper and lower partition walls 14, 15 of the opening 11 are not present on the same flat surface as in Comparative Example 2, a flat tool cannot be used, which makes it difficult to position the toner seal in the attached position 12. Therefore, defective attachment of a toner seal is likely to occur and the toner may leak. In the case of Embodiment 1, the attachment surface (attached position 12) of the toner seal is present on the same flat surface, and hence, a toner seal can be attached easily without any defects. Further, the toner seal also functions as a member for forming the buffer portion S, and hence production can be carried out with a smaller number of steps.

The leakage of the toner during transportation occurs when a large vibration is applied. In the case of Comparative Example 3, when a large vibration is applied, the open/close member 16 is vibrated and the opening 11 is opened. Therefore, the toner moves from the developer container 2 to the developing chamber 4. The toner having moved to the developing chamber 4 leaks from between the developer carrying member 6 and the regulating member 5 that is in contact with the developer carrying member 6 or between the developer carrying member 6 and the sealing member 7 when a vibration is applied. In the case of Embodiment 1, a toner seal can be attached to the entire periphery of the opening 11, and hence the toner does not move to the developing chamber 4 even when a vibration is applied during transportation.

The density follow-up property may be degraded when the movement of the toner from the developer container 2 to the developing chamber 4 becomes lower than the toner consumed amount. In Comparative Example 3, if the stiffness of the open/close member 16 is enhanced to such a degree as not to be vibrated even when receiving a vibration in order to prevent the toner from leaking during transportation, the open/close member 16 hardly moves by the force pushed by the toner during use, and hence, the density follow-up property may be degraded. Therefore, in Comparative Example 3, it is difficult to satisfy both the leakage prevention of toner during transportation and the density follow-up property. In the case of Embodiment 1, the toner corresponding to the amount consumed from the developing chamber 4 is supplied sequentially from the buffer portion S, and hence, the density follow-up property can be maintained.

Regarding the toner exchange property between the developer container and the developing chamber, if there is a difference in movement of the toner due to the shape of the opening 11 between the case where the toner is directed from the developer container 2 to the developing chamber 4 and the case where the toner is directed from the developing chamber 4 to the developer container 2, the exchange of the toner can be suppressed. In the case of the opening 11 in a flat shape as in Comparative Example 1 illustrated in FIGS. 2A to 2D, the toner moves from the developer container 2 to the developing chamber 4, and the toner returns from the developing chamber 4 to the developer container 2. In contrast, in the case of Embodiment 1 illustrated in FIGS. 1A to 1D, when the toner is directed from the developer container 2 to the developing chamber 4, the toner 20 sent from the developer container 2 by the agitating member (conveying member) 3 has its flow changed in a downward direction along the remaining portion 9*b* of the sealing film 9 to be directed to the buffer portion S. Therefore, the toner 20 is not supplied directly to the developer supply member 8. In the buffer portion S, a deposited toner closes a passage as an immobile layer, and hence, the toner 21 cannot move from the developing chamber 4 to the developer container 2. That is, the toner is limited to the movement in one direction from the developer container 2 to the developing chamber 4 via the buffer portion S. Thus, the toner 20 in the developer container 2 can maintain initial toner characteristics until the later period of the use.

As described above, only the developing device in Embodiment 1 can satisfy all the ease of attachment of a toner seal, the prevention of the leakage of toner during transportation, the density follow-up property, and the toner exchange property between the developer container and the developing chamber.

Embodiment 2

Figure 6A:
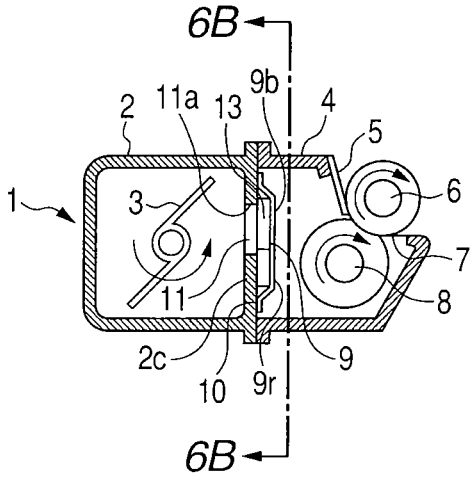
FIGS. 6A and 6B are schematic views of Embodiment 2.
Figure 6B:
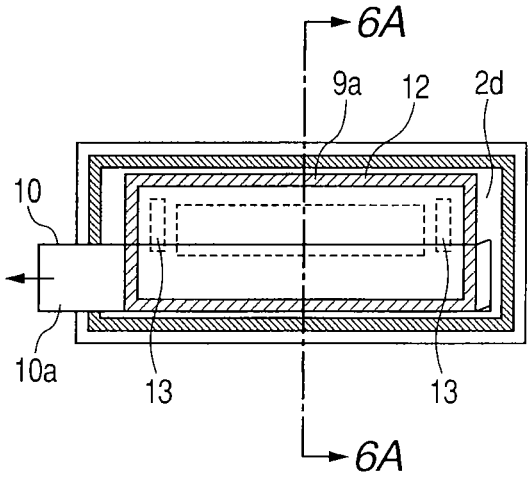

FIGS. 6A and 6B are schematic views of a developing device in Embodiment 2. FIG. 6A is a cross-sectional view taken along the line 6A-6A of FIG. 6B. FIG. 6B is a schematic view taken along the line 6B-6B of FIG. 6A. Hereinafter, the configuration different from that of Embodiment 1 will be described. The other configuration is the same as that of Embodiment 1, and hence, the description thereof is omitted. Difference from Embodiment 1 exists in that, as illustrated in FIG. 6A, the tear tape 10 extends along the surface of the sealing film 9 opposed to the opening 11, with a width of 10 mm from a position of 4 mm below the upper edge 11*a* of the opening 11. The other configuration is the same as that of Embodiment 1. The entire peripheral portion 9*a* of the sealing film 9 is attached to the wall surface 2*d* in a flat shape of the partition wall 2*c* at the attached position 12, and hence, the ease of attachment of a toner seal (sealing member) formed of the sealing film 9 and the tear tape 10 is satisfactory in the same way as in Embodiment 1. In use, a user pulls out the tear tape 10 from the developing device 1 while holding one end portion (extending portion 10*a*) of the tear tape 10 extending to the outside of the developing device 1. As the tear tape 10 is pulled out, the sealing film 9 is torn off in substantially the same width as that of the tear tape 10 and taken out of the developing device 1. More specifically, the sealing film 9 is separated into the remaining portion 9*b* and the removal portion 9*r* when one end portion (extending portion 10*a*) of the tear tape 10 is pulled out. The remaining portion 9*b* remains so as to cover the opening 11, and the removal portion 9*r* is removed from the opening 11. The removal portion 9*r* is taken out of the developer container 2. The free end (not shown) of the sealing film 9 is positioned below the upper edge 11*a* of the opening 11. In the developing device 1 with a toner seal opened, a space (a buffer portion) sandwiched between the partition wall 2*c* and the remaining portion 9*b* of the sealing film 9 is not formed. However, the partition wall 2*c* on the lower side of the opening 1 has the same role as that of the first partitioning plate 14 of Comparative Example 2, and the remaining portion 9*b* of the sealing film 9 has the same role as that of the second partitioning plate 15. When the developing device 1 is driven, the partition wall 2*c* on the lower side of the opening 11 reduces the amount of the toner returning from the developing chamber 4 to the developer container 2. Further, the remaining portion 9*b* of the sealing film 9 prevents the toner from moving from the developer container 2 directly to the developer supply member 8. Consequently, the movement of the toner between the developer container 2 and the developing chamber 4 is limited.

Embodiment 3

In Embodiment 3, difference from Embodiment 1 exists in that a sealing film formed of a biaxially-oriented polyester layer with a thickness of 15 μm, a polyethylene layer with a thickness of 20 μm, and an adhesive polyolefin layer with a thickness of 50 μm is used as a toner seal. In Embodiment 3, the sealing film is a sealing member. In the sealing film, only the biaxially-oriented polyester layer is cut on a line of 4 mm below the lower edge of the opening by laser processing to form a cut line. The cut line is a ripping line, i.e., a tear-off line for tearing apart the sealing film. The cut line (ripping line, i.e., tear-off line) may be continuous or intermittent. One end portion of the sealing film is folded to extend to the outside of the developing device in the same way as in the tear tape in Embodiment 1 to form an extending portion. The other configuration is the same as that of Embodiment 1. In use, a user pulls out the sealing film from the developing device while holding one end portion (extending portion) of the sealing film extending to the outside of the developing device. The sealing film is torn off along the cut line subjected to laser processing, whereby a lower-side portion of the sealing film is removed to the outside of the developing device. More specifically, when one end portion (extending portion) of the sealing film is pulled out, the sealing film is separated into a remaining portion and a removal portion, and the removal portion is taken out of the developer container. After the toner seal is opened, the sealing film has the same shape as that in the case of using the tear tape in Embodiment 1. According to Embodiment 3, the toner seal is attached to a flat surface, and hence, the ease of attachment is satisfactory in the same way as in Embodiment 1. Further, only the sealing film is used without using the tear tape, and hence, it is not necessary to attach the sealing film to the tear tape, which enables a toner seal to be produced at a low cost.

Embodiment 4

In Embodiment 4, difference from Embodiment 1 exists in that a resin-molded component with a height of 2 mm is bonded to a wall surface instead of forming a protrusion with a height of 2 mm as a spacing holding member integrally with a wall surface of a partition wall. The other configuration is the same as that of Embodiment 1. In the case of Embodiment 1, in order to change the width in the vertical direction of the buffer portion S, it is necessary to change a mold for a developer container. In contrast, in the case of Embodiment 4, the resin-molded component may be merely modified for changing the width of the buffer portion S in the vertical direction. Therefore, the change in the mold for a developer container involved in the change in specifications is not necessary. In Embodiment 4, though the protrusion as the spacing holding member is fixed to the wall surface of the developing chamber, the present invention is not limited thereto. The protrusion as the spacing holding member may be fixed to a sheet member (toner seal). Alternatively, the protrusion as a spacing holding member may be fixed to both the wall surface of the developing chamber and the sheet member (toner seal).

Embodiment 5

Figure 7A:
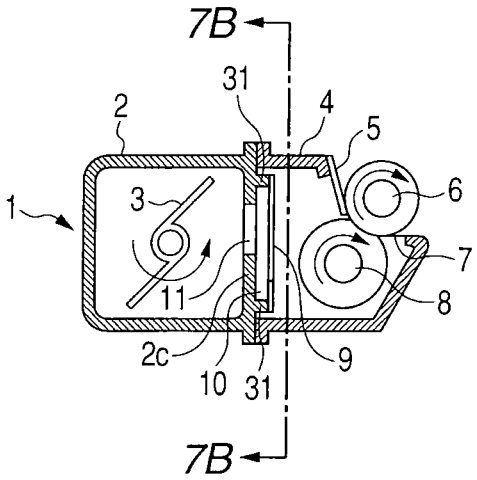
FIGS. 7A and 7B are schematic views of Embodiment 5.
Figure 7B:
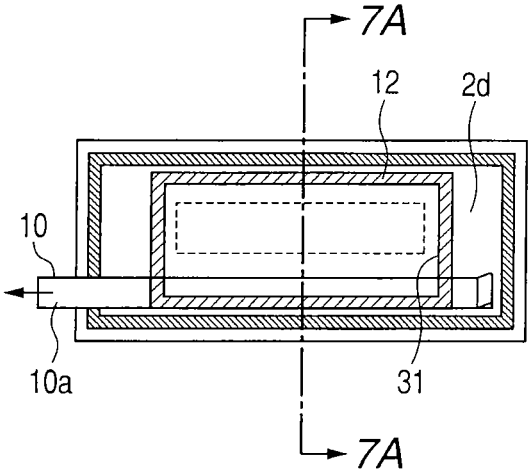

FIGS. 7A and 7B are schematic views of a developing device in Embodiment 5. FIG. 7A is a cross-sectional view taken along the line 7A-7A of FIG. 7B. FIG. 7B is a cross-sectional view taken along the line 7B-7B of FIG. 7A. In Embodiment 5, difference from Embodiment 1 exists in that, as illustrated in FIGS. 7A and 7B, a seal attachment seat surface 31 with a height of 2 mm surrounding the opening 11 is formed integrally with the wall surface 2*d* of the partition wall 2*c* instead of the protrusion. The sealing film 9 may be attached to the seal attachment seat surface 31. In the case of Embodiment 1, it is necessary to attach the sealing film 9 to the wall surface 2*d* while stretching the sealing film 9. In contrast, in the case of Embodiment 5, the sealing film 9 can be attached to the seal attachment seat surface 31 in a flat shape, and hence the attachment operability is satisfactory. In Embodiment 5, though the seal attachment seat surface 31 is formed integrally with the wall surface, the present invention is not limited thereto. The seal attachment seat surface 31 may be formed as a separate member and fixed (bonded) to the wall surface 2*d*.

Embodiment 6

Figure 8:
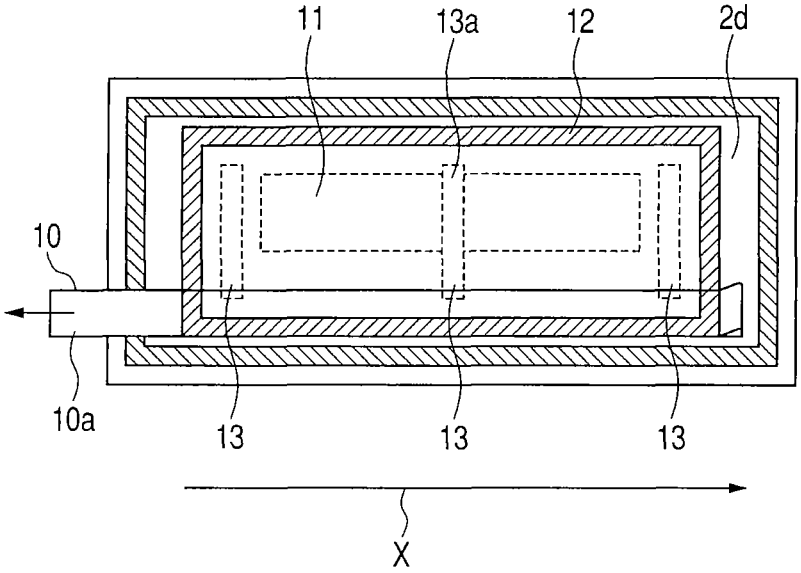
FIG. 8 is a schematic view of Embodiment 6.

FIG. 8 is a schematic view of a developing device in Embodiment 6. In Embodiment 6, difference from Embodiment 1 exists in that, as illustrated in FIG. 8, a protrusion 13*a* with a height of 2 mm is provided so as to overlap the opening 11 in addition to the formation of the protrusion 13 with a height of 2 mm as a spacing holding member on the wall surface 2*d* on the side of the developing chamber 4 on both sides of the opening 11. In the case of Embodiment 1, when the developing chamber 4 is excessively filled with the toner 21, the remaining portion 9*b* of the sealing film 9 is pushed toward the developer container 2, and there is a possibility that the spacing "d" of the buffer portion S may be changed. When the protrusion 13*a* is added so as to overlap the opening 11 as in this embodiment, the remaining portion 9*b* of the sealing film 9 is suppressed from being deformed, whereby the spacing "d" of the buffer portion S can be kept stably.

Embodiment 7

In Embodiment 7, difference from Embodiment 1 exists in that the sealing film 9 is also bonded to the contact portion with the protrusion 13. The sealing film 9 may also be bonded to the protrusion 13*a* provided so as to overlap the opening 11 in Embodiment 6. More specifically, in Embodiment 7, the protrusion 13 (13*a*) as a spacing holding member is fixed to both the wall surface 2*d* of the developing chamber 4 and the sheet member (toner seal). In the case where the sealing film 9 is not bonded to the protrusion 13, when the momentum of the supply of the toner from the developer container 2 to the developing chamber 4 is strong, the toner 20 pushes the sealing film 9 to bend the sealing film 9 toward the developing chamber 4. This changes the spacing "d" of the buffer portion S, with the result that the movement of a toner from the developer container 2 to the developing chamber 4 becomes unstable. In Embodiment 7, since the sealing film 9 is bonded to the protrusion 13, and hence the spacing "d" of the buffer portion S can be kept stably.

Embodiment 8

Embodiment 8 is a modification of Embodiment 6. In Embodiment 8, difference from Embodiment 6 exists in that the height of the protrusion 13 on both sides of the opening 11 is set at 1 mm, and the height of the protrusion 13*a* overlapping the opening 11 is set at 2 mm. In the case of Embodiment 8, the spacing "d" of the buffer portion S is 2 mm in the center portion and 1 mm in both end portions. The spacing "d" changes smoothly between the center portion and the end portions. Thus, the spacing "d" of the buffer portion S is changed in a longitudinal direction X of the developer container 2, i.e., the opening 11, and hence the amount of the toner passing through the buffer portion S can be set to be substantially uniform in the longitudinal direction X of the opening 11. For example, in the case of using an agitating vane made of a flexible film with a uniform thickness as the agitating member 3 of the developer container 2, the flexible film is bent and both end portions have a higher toner conveying ability from the developer container 2 to the developing chamber 4, compared with the center portion. In contrast, the difference in a toner conveying ability can be reduced by changing the spacing "d" of the buffer portion S in the longitudinal direction X. Thus, the conveying amount of the toner can be made substantially uniform in the longitudinal direction X of the opening 11.

Embodiment 9

Figure 9:
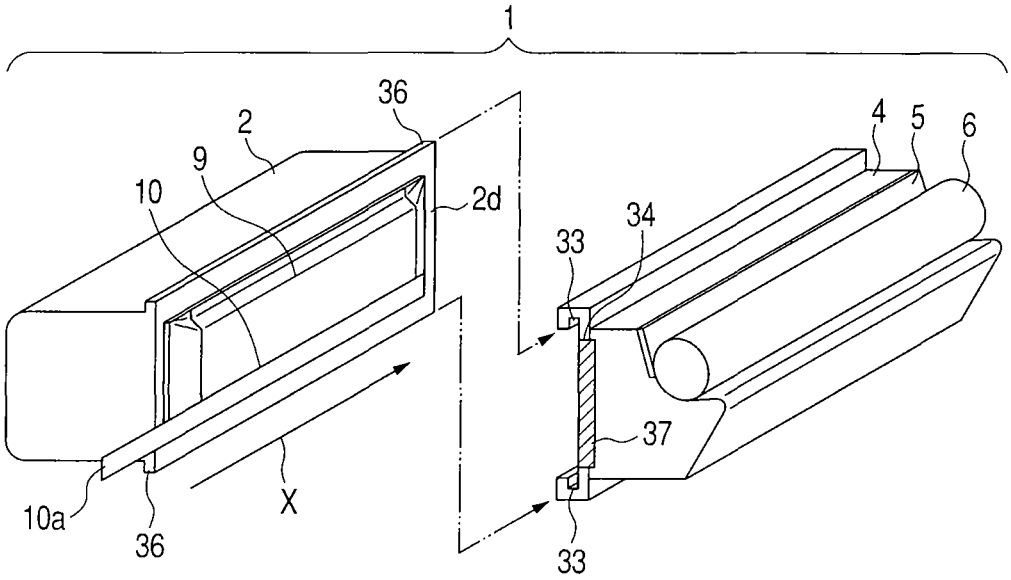
FIG. 9 is a schematic view of Embodiment 9.

FIG. 9 is a schematic view of a developing device in Embodiment 9. Difference from Embodiment 1 exists in that, as illustrated in FIG. 9, the developer container 2 and the developing chamber 4 can be separated from one another in Embodiment 9. In the developer container 2, guide protrusions 36 extending in the longitudinal direction X in parallel with the wall surface 2*d* are provided on a top portion and a bottom portion of the developer container 2. In the developing chamber 4, guide grooves 33 extending in the longitudinal direction X in parallel with the axial direction of the developer carrying member (developing roller) 6 are provided on a top portion and a bottom portion of the developing chamber 4. The guide protrusions 36 can be engaged slidably with the guide grooves 33. The guide protrusions 36 of the developer container 2 are inserted in the guide grooves 33 along the axial direction of the developer carrying member 6 to allow the developer container 2 to move slidably relative to the developing chamber 4, whereby the developer container 2 is connected to the developing chamber 4. The sealing film 9 is protruded from the wall surface 2*d* having the opening 11 of the developer container 2 by the protrusion 13 as a spacing holding member. The side portion of the developing chamber 4 is provided with an inlet 37 for passing the protruded sealing film 9. A sponge 34 is attached to the inlet 37. After the developer container 2 is connected to the developing chamber 4, the extending portion 10*a* of the tear tape 10 extending to the outside of the developing device 1 is pulled out to draw out the tear tape 10 from the developing device 1, and under this condition, the developing device 1 is used. In the case of Embodiment 9, the developer container 2 and the developing chamber 4 can be separated from each other, and hence the configuration of only the developer container 2 can be formed as the form of a cartridge. Further, the developer container 2 can also be detachably mountable to the apparatus main body 101 of the image forming apparatus 100 as a developer cartridge.

Embodiment 10

Figure 10:
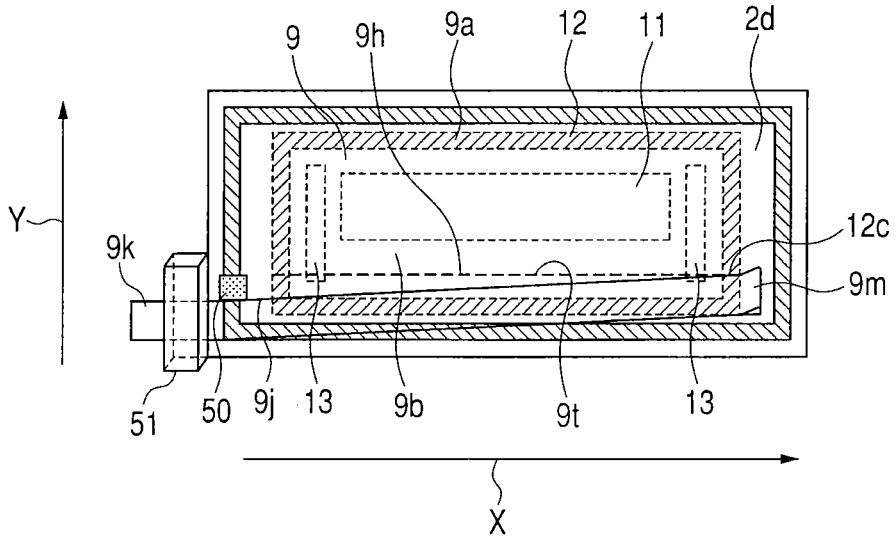
FIG. 10 is a schematic view of Embodiment 10.

FIG. 10 is a schematic view of a developing device in Embodiment 10. As illustrated in FIG. 10, Embodiment 10 is different from Embodiment 3 in that a sealing film regulating portion (sealing member regulating portion) 50 for regulating the sealing film 9 in a width direction Y is provided at one end portion of the developer container 2 in the longitudinal direction X. The width direction Y of the sealing film 9 is perpendicular to the longitudinal direction X of the developer container 2, i.e., the opening 11. In the same way as in Embodiment 3, one end portion 9*k* of the sealing film 9 is folded at a folded portion 9*m* to form an extending portion 9*k* extending to the outside of the developing device 1. The extending portion 9*k* extends to the outside of the developing device 1 through a sealing film removing opening (sealing member removing opening) 51 provided at the developer container 2. The sealing film removing opening 51 may be provided at the developing chamber 4 or may be formed between the developer container 2 and the developing chamber 4. In use, a user pulls out the sealing film 9 from the developing device 1 while holding one end portion (extending portion) 9*k* of the sealing film 9 extending to the outside of the developing device 1. The sealing film 9 is torn off along the cut line 9*t* subjected to laser processing and pulled out of the developing device 1 while the free end 9*j* of a pullout portion of the torn-off sealing film 9 is being regulated by the sealing film regulating portion 50.

The sealing film regulating portion 50 is provided at the developer container 2. However, the sealing film regulating portion 50 may be provided at the developing chamber 4 or may be provided between the developer container 2 and the developing chamber 4. The sealing film regulating portion 50 is provided below the free end 9*h* in the remaining portion 9*b* of the sealing film 9 (in a direction in which the torn-off sealing film 9 leaves from the remaining portion 9*b* in the width direction Y). Therefore, when the sealing film 9 is pulled out from the developing device 1, the sealing film 9 is exactly pulled downward diagonally. If the sealing film 9 is pulled upward diagonally, when the sealing film 9 is torn off, a force acts in a direction in which the remaining portion 9*b* of the sealing film 9 is compressed. The entire peripheral portion 9*a* of the sealing film 9 is attached to the wall surface 2*d* at the attached position 12, and hence the sealing film 9 has little room for absorbing the deformation caused by the force acting when the sealing film 9 is torn off. Thus, the attached portion 12*c* in the vicinity of the folded portion 9*m* of the sealing film 9 may curl up partially, and the free end 9*h* at the remaining portion 9*b* of the sealing film 9 may become wavy. Once the attached portion 12*c* curls up or the free end 9*h* becomes wavy, there arises a variation in the spacing "d" of the buffer portion S which is sandwiched between the wall surface 2*d* and the remaining portion 9*b* of the sealing film 9 and held by the spacing holding member 13.

In contrast, in the case where the sealing film 9 is pulled out downward and torn off as in this embodiment, a force acts on the remaining portion 9*b* of the sealing film 9 in a tensile direction (the direction in which the sealing film 9 leaves from the remaining portion 9*b* in the width direction Y). Therefore, the occurrence of curling at the attached portion 12*c* of the remaining portion 9*b* of the sealing film 9 is prevented, and the free end 9*h* at the remaining portion 9*b* of the sealing film 9 can be suppressed from becoming wavy. Consequently, the spacing "d" of the buffer portion S can be formed uniformly in the longitudinal direction.

In this embodiment, the sealing film regulating portion 50 is provided in the developing device of Embodiment 3 using the sealing film with the cut line 9*t* formed thereon. However, even if the sealing film regulating portion 50 is provided in the developing device of Embodiment 1 using the sealing film to which the tear tape 10 is attached, the same effects as those in this embodiment are obtained.

Embodiment 11

Figure 11:
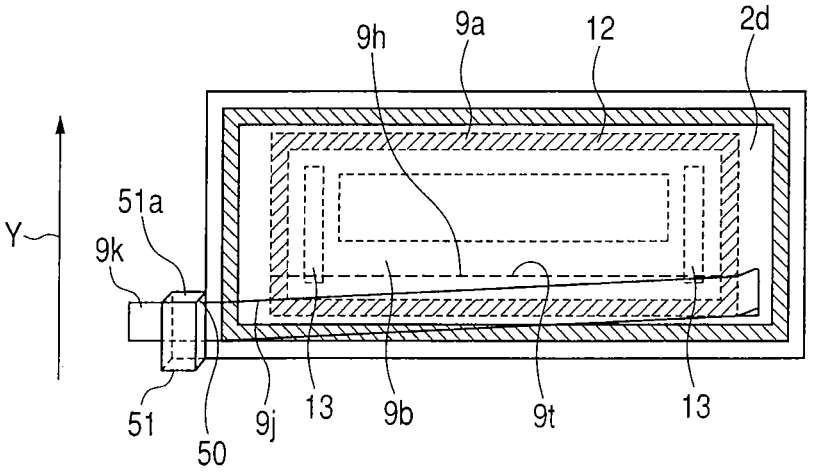
FIG. 11 is a schematic view of Embodiment 11.

FIG. 11 is a schematic view of a developing device in Embodiment 11. As illustrated in FIG. 11, Embodiment 11 is different from Embodiment 10 in that a part of the sealing film removing opening 51 for taking out the sealing film 9 outside of the developing device 1 is used as the sealing film regulating portion 50. A part of the sealing film removing opening 51 is configured so as to function as the sealing film regulating portion 50. In this embodiment, the part of the sealing film removing opening 51 is an upper edge portion 51*a* of the sealing film removing opening 51. However, the present invention is not limited thereto, and any portion of the sealing film removing opening 51 may be configured as a regulating portion for regulating the movement of the sealing film 9 in the width direction Y. Alternatively, the sealing film regulating portion 50 may be provided at the upper edge portion 51*a* of the sealing film removing opening 51 or in the vicinity thereof. Though the sealing film removing opening 51 is provided in the developer container 2, the sealing film removing opening 51 may be provided in the developing chamber 4. Alternatively, the sealing film removing opening 51 may be formed between the developer container 2 and the developing chamber 4. The upper edge portion 51*a* of the sealing film removing opening 51 that functions as the sealing film regulating portion 50 is provided below the free end 9*h* of the remaining portion 9*b* of the sealing film 9 (in a direction in which the torn-off sealing film 9 leaves from the remaining portion 9*b* in the width direction Y). Thus, when the sealing film 9 is pulled out of the developing device 1, the sealing film 9 is exactly pulled downward diagonally.

By using a part of the sealing film removing opening 51 for taking out the sealing film 9 from the developing device 1 as the sealing film regulating portion, the same effects as those in Embodiment 10 are obtained, and in addition, the pullout passage of the sealing film 9 can be simplified. This enables a load required for pulling out the sealing film 9 to be suppressed.

Embodiment 12

Figure 12A:
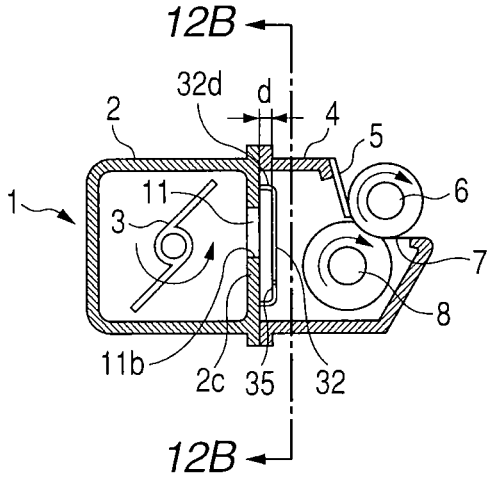
FIGS. 12A and 12B are schematic views of Embodiment 12 before opening the toner seal.
Figure 12B:
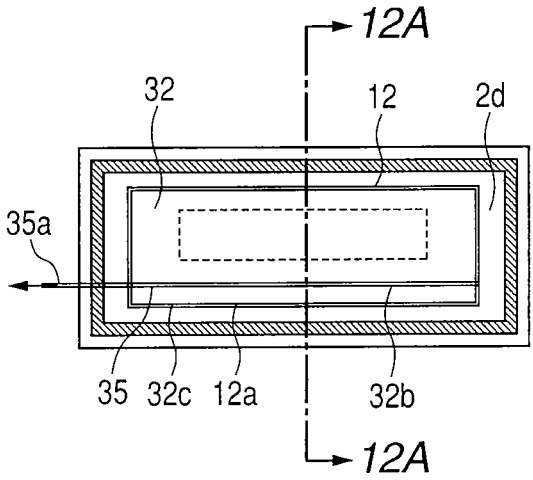
Figure 12C:
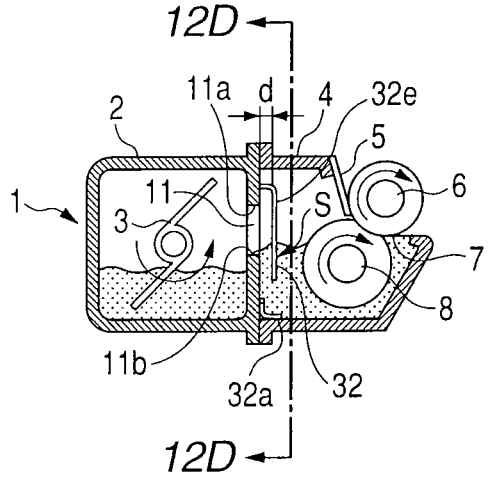
FIGS. 12C and 12D are schematic views of Embodiment 12 after opening the toner seal.
Figure 12D:
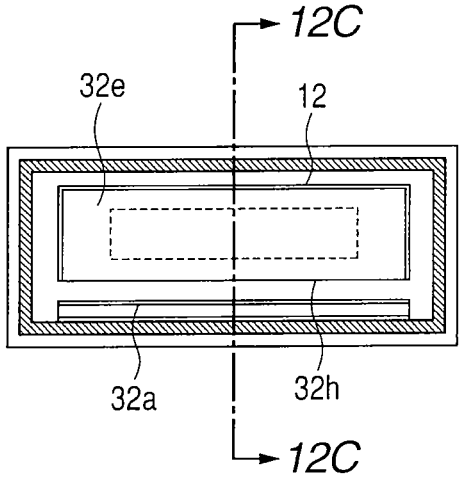

FIGS. 12A to 12D are schematic views of a developing device in Embodiment 12. FIGS. 12A and 12B are schematic views of the developing device in Embodiment 12 before a toner seal is opened. FIGS. 12C and 12D are schematic views of the developing device in Embodiment 12 after the toner seal is opened. FIG. 12A is a cross-sectional view taken along the line 12A-12A of FIG. 12B. FIG. 12B is a cross-sectional view taken along the line 12B-12B of FIG. 12A. FIG. 12C is a cross-sectional view taken along the line 12C-12C of FIG. 12D. FIG. 12D is a cross-sectional view taken along the line 12D-12D of FIG. 12C. In Embodiment 12, difference from Embodiment 1 exists in that, as illustrated in FIGS. 12A to 12D, a resin-molded component is used as a sealing member (shielding member) for sealing a developer in the developer container 2, instead of a sealing film. A resin-molded component (sealing member) 32 of an ABS resin with a wall thickness of 150 μm obtained by molding a swollen portion 32*d* with a height (spacing "d") of 2 mm so as to surround the opening 11 is attached to the wall surface 2*d* of the partition wall 2*c* at the attached position 12. A cut-away portion 32*b* with a depth of 100 μm is molded in the resin-molded component 32 at a position of 4 mm below the lower edge 11*b* of the opening 11. One end portion of a metal wire 35 is fixed to the cut-away portion 32*b*, the wire 35 is wound around the cut-away portion 32*b*, and the other end portion of the wire 35 is extended to the outside of the developing device 1, whereby an extending portion 35*a* is formed. Further, a lower cut-away portion 32*c* with a depth of 120 μm is molded in the vicinity of the lower-side attached position 12*a* of the resin-molded component 32. In use, a user pulls out the wire 35 from the developing device 1 while holding the extending portion 35*a* of the wire 35 extending to the outside of the developing device 1, whereby the resin-molded component 32 is cut along the cut-away portion 32*b*. More specifically, by pulling the extending portion 35*a* of the wire 35, the resin-molded component 32 is separated into an upper-side portion (remaining portion) 32*e* and a lower-side portion (removal portion) 32*a*, and the lower-side portion 32*a* remains attached to the developer container 2. As illustrated in FIGS. 12C and 12D, the lower-side portion 32*a* of the cut resin-molded component 32 is deformed downward with respect to the lower-side cut-away portion 32*c* due to the weight of the lower-side portion 32*a* and the weight of a toner supplied from the developer container 2 to the developing chamber 4. The free end 32*h* of the upper-side portion (remaining portion) 32*e* of the torn-off resin-molded component 32 is positioned below the upper edge 11*a* of the opening 11. Particularly, in Embodiment 12, the free end 32*h* is positioned below the lower edge 11*b* of the opening 11. This enables a toner to move from the developer container 2 to the developing chamber 4. In the case of Embodiment 12, the resin-molded component 32 is used as a shielding member, and hence it is unnecessary to attach the sealing film to the wall surface 2*d* while stretching the sealing film as in Embodiment 1. Thus, it is easy to attach the resin-molded component 32 as a shielding member. Further, the swollen portion 32*d* with a height of 2 mm is molded in the resin-molded component 32, and hence the spacing "d" of the buffer portion S can be kept even without providing the protrusion 13 to the developer container 2. In Embodiment 12, though the resin-molded component 32 is used as a sealing member, the present invention is not limited thereto. In the case where a sheet member formed of a sealing film and a tear tape is used as a sealing member, the swollen portion 32*d* with a height of 2 mm may be formed around the sheet member. The swollen portion 32*d* functions as a spacing holding member, whereby the same effects as those in Embodiment 12 can be exhibited.

Embodiment 13

Figure 13A:
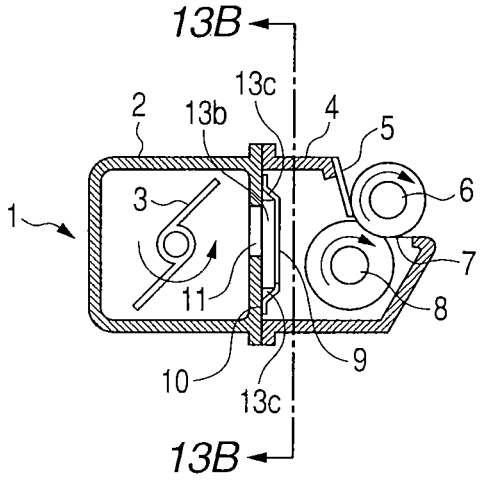
FIGS. 13A and 13B are schematic view of Embodiment 13.
Figure 13B:
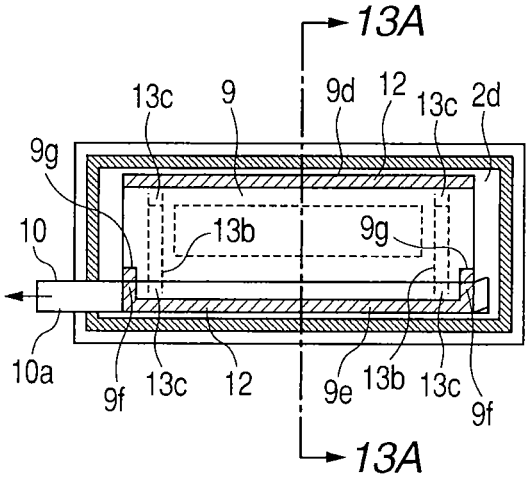
Figure 14:
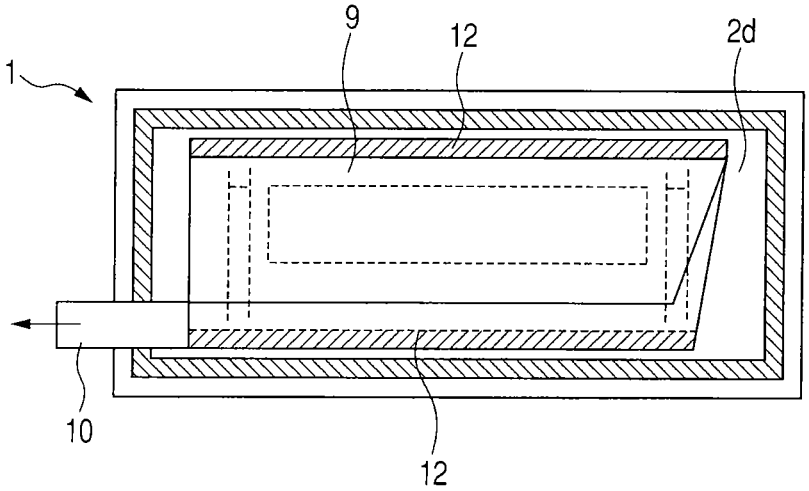
FIG. 14 is an illustration diagram in the case where the peripheral portion of a tear tape is not attached.

FIGS. 13A and 13B are schematic views of a developing device in Embodiment 13. FIG. 13A is a cross-sectional view taken along the line 13A-13A of FIG. 13B. FIG. 13B is a cross-sectional view taken along the line 13B-13B of FIG. 13A. In Embodiment 13, difference from Embodiment 1 exists in that, as illustrated in FIGS. 13A and 13B, the entire peripheral portion 9*a* of the sealing film 9 is not attached to the wall surface 2*d*. An upper side 9*d* and a lower side 9*e* of the sealing film 9, a portion 9*f* corresponding to the tear tape 10, and a peripheral portion 9*g* thereof are attached to the wall surface 2*d* at the attached position 12. Further, Embodiment 13 is different from Embodiment 1 in that the protrusion 13*b* has slopes 13*c* in an upper end portion and a lower end portion and is connected to the wall surface 2*d* smoothly through the slopes. A portion of the sealing film 9 that is not attached to both ends in the longitudinal direction is sealed by the contact with the protrusion 13*b*. The reason why the portion 9*f* corresponding to the tear tape 10 and the peripheral portion 9*g* thereof are attached to the wall surface 2*d* will be described with reference to FIG. 14. FIG. 14 is an illustration diagram in the case where the peripheral portion of the tear tape 10 is not attached. As illustrated in FIG. 14, in the case where the peripheral portion of the tear tape 10 is not attached, the sealing film 9 curls up and cannot be cut when the tear tape 10 is pulled out of the developing device 1. In contrast, in Embodiment 13, the portion 9*f* corresponding to the tear tape 10 and the peripheral portion 9*g* thereof are attached to the wall surface 2*d*, and hence, the sealing film 9 is cut without curling up together with the tear tape 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-049307, filed Mar. 3, 2009, and Japanese Patent Application No. 2009-258099, filed Nov. 11, 2009, which are hereby incorporated by reference herein in their entireties.

What is claimed is:

1. A developer container, which contains a developer to be supplied to a developing chamber used in an electrophotographic image forming apparatus, the developer container comprising:

a partition wall configured to partition the developer container from the developing chamber;

a conveying member configured to convey the developer to an opening provided in the partition wall to supply the developer in the developer container to the developing chamber;

a sealing member that covers the opening on a side of the developing chamber, wherein, when the sealing member opens the opening, the sealing member is separated into a remaining portion and a removal portion, and a free end of the remaining portion is positioned below an upper edge of the opening; and a spacing holding member disposed between a wall surface of the partition wall and the sealing member, and configured to hold a spacing between the wall surface and the sealing member.

2. A developer container according to claim 1, wherein the free end is positioned below a lower edge of the opening.

3. A developer container according to claim 2, wherein the remaining portion of the sealing member and the wall surface form a passage configured to convey downward the developer to be conveyed from the opening of the developer container to the developing chamber.

4. A developer container according to claim 1, wherein the spacing holding member is fixed to the wall surface of the partition wall, or the sealing member, or both the wall surface and the sealing member.

5. A developer container according to claim 1, wherein the spacing holding member is formed on the wall surface of the partition wall and integrated with the partition wall or formed on the sealing member and integrated with the sealing member.

6. A developer container according to claim 1, wherein the spacing holding member is disposed in a position in which the spacing holding member overlaps with the opening.

7. A developer container according to claim 1, wherein the sealing member is formed of a resin-molded component having a swollen portion formed on a periphery of the resin-molded component, and the swollen portion functions as the spacing holding member.

8. A developer container according to claim 1, wherein the spacing between the wall surface and the sealing member changes in a longitudinal direction of the opening.

9. A developer container according to claim 1, wherein the developer container is detachably mountable to the developing chamber that rotatably supports a developer carrying member.

10. A developer container according to claim 1, wherein the developer container comprises a developer cartridge which is detachably mountable to an apparatus main body of the electrophotographic image forming apparatus.

11. A developing device comprising:

a developer carrying member;

a developing chamber that rotatably supports the developer carrying member; and a developer container as recited in claim 1.

12. A developing device according to claim 11, wherein the developing device comprises a developer cartridge detachably mountable to an apparatus main body of the electrophotographic image forming apparatus.

13. A process cartridge which is detachably mountable to an apparatus main body of an electrophotographic image forming apparatus, the process cartridge comprising:

an electrophotographic photosensitive member;

process means for acting on the electrophotographic photosensitive member; and a developing device as recited in claim 11.

14. A process cartridge according to claim 13, wherein the process means is at least one of a charging device and a cleaning device.

15. A developer container according to claim 1, wherein the developer container has an extending portion that is provided on the sealing member and extends from the sealing member to an outside of the developer container, wherein, when the extending portion is pulled, the sealing member is separated into the remaining portion and the removal portion.

16. A developer container according to claim 15, wherein the sealing member comprises a sealing film covering the opening and a flexible tape which extends along one surface side of the sealing film and has one end portion which forms the extending portion extending to the outside of the developer container.

17. A developer container according to claim 15, wherein the sealing member comprises a sealing film with a continuous or intermittent tear-off line formed thereon, the sealing film covers the opening, and one end portion of the sealing film forms the extending portion extending to the outside of the developer container.

18. A developer container according to claim 15, wherein the developer container has, in one end portion of the developer container in a longitudinal direction thereof, a sealing member regulating portion configured to regulate a movement of a free end of a pullout portion of the sealing member in a width direction when the extending portion is pulled, and the sealing member regulating portion is positioned below the free end of the remaining portion.

19. A developer container according to claim 18, wherein the sealing member regulating portion is a part of a sealing member removing opening through which the sealing member is pulled out to the outside of the developer container.

20. A developer container according to claim 1, wherein the sealing member is attached to the wall surface of the partition wall on the side of the developing chamber.

21. A developer container according to claim 1, wherein the spacing holding member is provided on each of at least both sides of the opening in a longitudinal direction.

* * * * *